US010321538B2

(12) United States Patent
Diao

(10) Patent No.: US 10,321,538 B2
(45) Date of Patent: Jun. 11, 2019

(54) PROTECTIVE CIRCUIT FOR OUTPUT TERMINAL CAPACITOR OF LIGHT-EMITTING DIODE (LED) DRIVER

(71) Applicant: OPPLE LIGHTING CO., LTD., Shanghai (CN)

(72) Inventor: Xianjiang Diao, Shanghai (CN)

(73) Assignee: OPPLE LIGHTING CO., LTD., Shanghai (CN)

( * ) Notice: Subject to any disclaimer, the term of this patent is extended or adjusted under 35 U.S.C. 154(b) by 38 days.

(21) Appl. No.: 15/603,114

(22) Filed: May 23, 2017

(65) Prior Publication Data

US 2017/0257915 A1 Sep. 7, 2017

Related U.S. Application Data

(63) Continuation of application No. PCT/CN2015/000823, filed on Nov. 27, 2015.

(30) Foreign Application Priority Data

Nov. 25, 2014 (CN) ..... 2014 1 0690465

(51) Int. Cl.
*H05B 33/08* (2006.01)
*H05B 37/02* (2006.01)

(52) U.S. Cl.
CPC ..... *H05B 33/089* (2013.01); *H05B 37/02* (2013.01)

(58) Field of Classification Search
None
See application file for complete search history.

(56) References Cited

U.S. PATENT DOCUMENTS 8,258,706 B2 9/2012 Maruyama et al.
8,810,135 B2 8/2014 Maruyama et al.
(Continued)

FOREIGN PATENT DOCUMENTS

CN 202197098 U * 4/2012
CN 203352856 U 12/2013
(Continued)

OTHER PUBLICATIONS

International Search Report (including English translation) issued in corresponding International Application No. PCT/CN2015/000823, dated Feb. 29, 2016, 7 pages.
(Continued)

*Primary Examiner* — Jimmy T Vu
*Assistant Examiner* — Laura Yesildag
(74) *Attorney, Agent, or Firm* — Arch & Lake LLP

(57) ABSTRACT

The present disclosure discloses a protective circuit for an output terminal capacitor of a light-emitting diode (LED) driver, and a method for providing the protective circuit. The protective circuit is connected to two ends of the output terminal capacitor and includes a switching element, a voltage dividing unit and a one-way conduction unit. The switching element is in parallel connection with the output terminal capacitor, the one-way conduction unit is connected between the switching element and the output terminal capacitor, the switching element is switched on when a voltage exceeds a threshold so as to establish a short circuit between two ends of the output terminal capacitor and prevent an excessively large voltage from being applied to the output terminal capacitor, and the one-way conduction unit allows a current to flow across the output terminal capacitor from the protective circuit by a one-way conduction.

14 Claims, 2 Drawing Sheets

(56) References Cited

U.S. PATENT DOCUMENTS

| | | | | |
|---|---|---|---|---|
| 2010/0090604 | A1 | 4/2010 | Maruyama et al. | |
| 2011/0267142 | A1* | 11/2011 | Wismar ..... | H02M 3/157<br>330/129 |
| 2013/0026946 | A1 | 1/2013 | Maruyama et al. | |

FOREIGN PATENT DOCUMENTS

| | | | |
|---|---|---|---|
| CN | 103683885 | A | 3/2014 |
| CN | 104411051 | A | 3/2015 |
| CN | 204859603 | U | 12/2015 |

OTHER PUBLICATIONS

Written Opinion issued in corresponding International Application No. PCT/CN2015/000823, dated Feb. 29, 2016, 5 pages.
First Office Action (including English translation) issued in corresponding Chinese Application No. 201410690465.4, dated Mar. 25, 2016, 10 pages.
Second Office Action (including English translation) issued in corresponding Chinese Application No. 201410690465.4, dated Oct. 31, 2016, 13 pages.

* cited by examiner

PROTECTIVE CIRCUIT FOR OUTPUT TERMINAL CAPACITOR OF LIGHT-EMITTING DIODE (LED) DRIVER

CROSS-REFERENCE TO RELATED APPLICATIONS

This application is based upon and claims the priority of PCT patent application No. PCT/CN2015/000823 filed on Nov. 27, 2015 which claims the priority of Chinese Patent Application No. 201410690465.4 filed on Nov. 25, 2014, the entire contents of all of which are hereby incorporated by reference herein for all purposes.

TECHNICAL FIELD

The present disclosure relates to a light-emitting diode (LED) driver circuit, in particular to a protective circuit for an output terminal capacitor of an LED driver.

BACKGROUND

An LED driver circuit often has a fixed output circuit topology, and its output terminal has a capacitor element. For example, a buck circuit topology has a simple wiring architecture and a low cost of an overall structure, and is widely applied in LED self-rectifying lamps. However, a LED driver circuit may have unusual situations including: 1. an abnormal short circuit of a power tube; and 2. an open output circuit (caused by abnormal conditions such as damage of an LED and disconnection of output lines, etc.). The abnormal situations may result in a large voltage at an output terminal, and hence result in the damage of an output terminal capacitor.

SUMMARY

The present disclosure provides a protective circuit for an output terminal capacitor of an LED driver, and a method for providing the protective circuit.

The present disclosure provides a protective circuit for an output terminal capacitor of an LED driver, with the protective circuit being connected to two sides of the output terminal capacitor. The protective circuit may include a switching element, a voltage dividing unit and a one-way conduction unit, where the switching element may be in parallel connection with the output terminal capacitor, the one-way conduction unit may be connected between the switching element and the output terminal capacitor, the switching element may be switched on when a voltage exceeds a threshold so as to establish a short circuit between two ends of the output terminal capacitor and prevent an excessively large voltage from being applied to the output terminal capacitor, and the one-way conduction unit may allow a current to flow across the output terminal capacitor from the protective circuit by a one-way conduction.

The present disclosure provides a method for providing a protective circuit for an output terminal capacitor of a light-emitting diode (LED) driver, with the protective circuit being connected to two sides of the output terminal capacitor. The method may include: connecting a switching element in parallel with the output terminal capacitor; connecting a one-way conduction unit between the switching element and the output terminal capacitor; switching a switching element on when a voltage exceeds a threshold so as to establish a short circuit between two ends of the output terminal capacitor and prevent an excessively large voltage from being applied to the output terminal capacitor; and allowing a current, by the one-way conduction unit, to flow across the output terminal capacitor from the protective circuit by a one-way conduction.

It should be understood that both the foregoing general description and the following detailed description are only exemplary and explanatory and are not restrictive of the disclosure.

BRIEF DESCRIPTION OF THE DRAWINGS

The accompanying drawings herein are incorporated in and become parts of the specification, illustrate embodiments consistent with the disclosure and, together with the description, serve to explain the principles of the disclosure.

Figure 1:
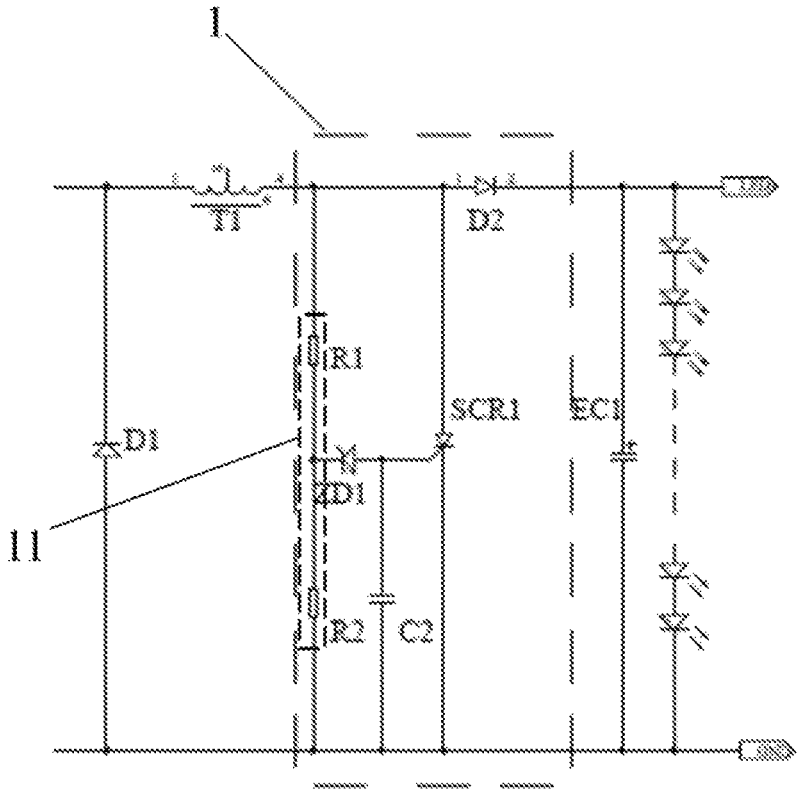
FIG. 1 is a circuit diagram of a preferred embodiment of a protective circuit for an output terminal capacitor of an LED driver provided by the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an example is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

An LED driver circuit often has a fixed output circuit topology, and its output terminal has a capacitor element. For example, a buck circuit topology has a simple wiring architecture and a low cost of an overall structure, and is widely applied in LED self-rectifying lamps. However, a LED driver circuit may have unusual situations including: 1. an abnormal short circuit of a power tube; and 2. an open output circuit (caused by abnormal conditions such as damage of an LED and disconnection of output lines, etc.). The abnormal situations may result in a large voltage at an output terminal, and hence result in the damage of an output terminal capacitor. Therefore, in order to overcome those defects, an improved protective circuit for an output terminal capacitor of an LED driver needs to be provided to protect the output terminal capacitor.

As illustrated in FIG. 1, the present disclosure provides a protective circuit 1 for an output terminal capacitor of an LED driver. The protective circuit 1 is connected to two sides of an output terminal capacitor EC1, and may include a switching element SCR1, a voltage dividing unit 11 and a one-way conduction unit D2. The switching element SCR1 is in parallel connection with the output terminal capacitor EC1; the one-way conduction unit D2 is connected between the switching element SCR1 and the output terminal capacitor EC1; the switching element SCR1 is switched on when a voltage exceeds a threshold, so as to establish a short circuit between two ends of the output terminal capacitor EC1 and prevent an excessively large voltage from being applied to the output terminal capacitor EC1; and the one-way conduction unit D2 allows a current to flow across the output terminal capacitor EC1 from the protective circuit 1 by a one-way conduction. Meanwhile, the one-way conduction unit D2 prevents the voltage released at the two ends of the output terminal capacitor EC1 from being applied to the protective circuit 1 in an opposite direction, so as to protect the switching element SCR1 of the protective circuit 1 from being damaged due to an excessively large voltage. An element indicated in the present disclosure refers to not only one independent electronic element, but also may refer to a circuit including a plurality of electronic elements.

In an embodiment, the switching element SCR1 is a thyristor. In other embodiments, the switching element SCR1 may be designed to be other elements or circuits with a threshold-voltage conduction function as needed.

In an embodiment, the one-way conduction unit D2 is a diode. In other embodiments, the one-way conduction unit D2 may also be other elements or circuits capable of achieving one-way conduction.

The protective circuit 1 further may include a threshold-voltage conduction unit ZD1. The threshold-voltage conduction unit ZD1 is connected between the voltage dividing unit 11 and the switching element SCR1, and is switched on when the voltage at the two ends of the protective circuit 1 exceeds a certain value. When a voltage after being divided by the voltage dividing unit 11 exceeds a certain value, the threshold-voltage conduction unit ZD1 is switched on, and then the switching element SCR1 is switched on. In an embodiment, the threshold-voltage conduction unit ZD1 is a triode, specifically for example, a voltage stabilizing triode. Thus, the conduction condition can be achieved by adoption of different voltage stabilizing triodes as needed, which is convenient and simple. In other embodiments, the threshold-voltage conduction unit ZD1 may also be other elements or circuits capable of achieving the threshold-voltage conduction.

In an embodiment, the voltage dividing unit 11 includes a first resistor R1 and a second resistor R2; and one end of the threshold-voltage conduction unit ZD1 is connected with the switching element SCR1, and another end of the threshold-voltage conduction unit ZD1 is connected between the first resistor R1 and the second resistor R2. In other embodiments, the voltage dividing unit 11 may also be adjusted as needed.

The protective circuit 1 further may include a filter capacitor C2. One end of the filter capacitor C2 is connected between the threshold-voltage conduction unit ZD1 and the switching element SCR1, and another end of the filter capacitor C2 is connected to a connection point between the switching element SCR1 and the output terminal capacitor EC1. The filter capacitor C2 is used for preventing incorrect operations of the protective circuit 1 caused by interference noise signals.

Figure 2:
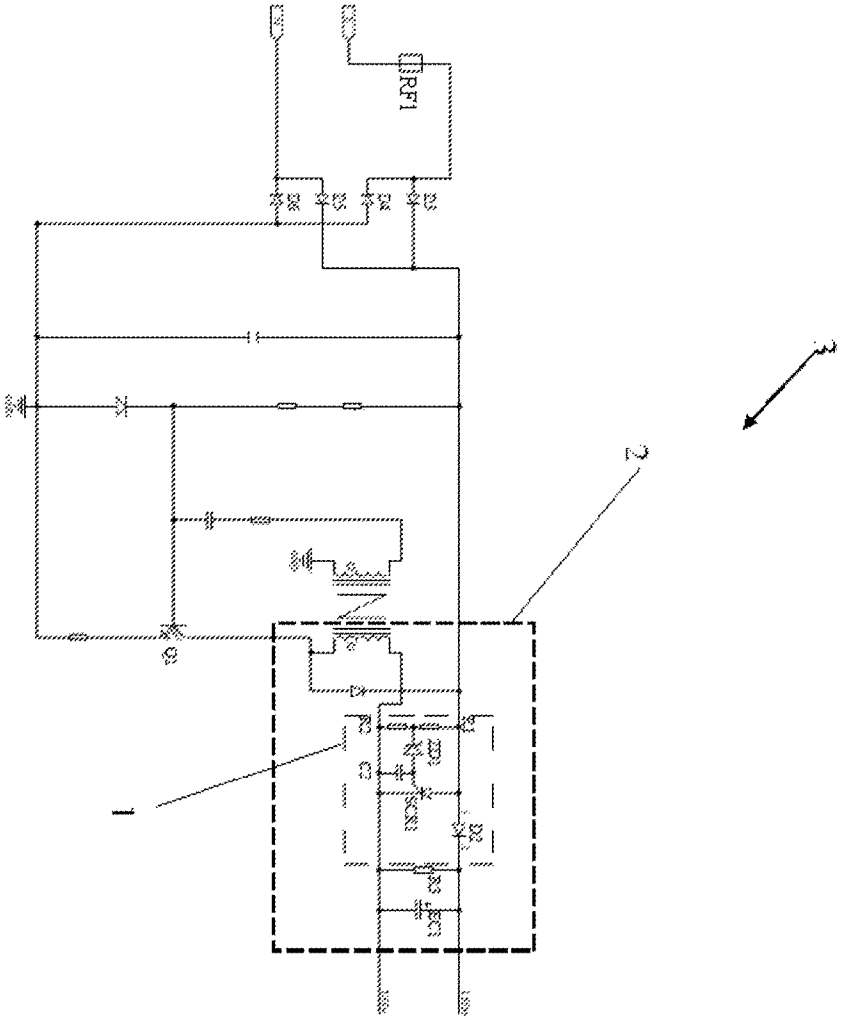
FIG. 2 is a circuit diagram of a preferred embodiment of an LED driver circuit provided by the present disclosure.

As shown in FIG. 2, the protective circuit 1 for the output terminal capacitor of the LED driver provided in the invention is mostly applied to an output terminal of an LED driver circuit 3 provided with a buck topology circuit 2. In other embodiments, the protective circuit 1 for the output terminal capacitor of the LED driver provided in the invention may also be applied in other topology circuits.

When the wirings operate normally, an output voltage is normal, and cannot break through the threshold-voltage conduction unit ZD1 after the voltage division of the first resistor R1 and the second resistor R2; the switching element SCR1 is in an off state as its voltage is lower than a trigger threshold; and the wirings may work properly.

In an abnormal condition of the wirings (e.g., an output open-circuit state), the output voltage is raised; the output voltage after being divided by the first resistor R1 and the second resistor R2 breaks down the threshold-voltage conduction unit ZD1; and the switching element SCR1 is switched on as the voltage reaches the trigger threshold. Thus, no excessive voltage will be applied to the output terminal capacitor EC1. Meanwhile, the one-way conduction unit D2 prevents energy stored on the output terminal capacitor EC1 from being recharged into the switching element SCR1, so as to prevent the switching element SCR1 from being damaged by an excessively large instantaneous current due to the conduction short circuit.

In another example, in another abnormal condition of the wirings of the circuit, when a triode Q1 of an LED driver circuit 3 is damaged with an emitter and a base being short-circuited, the output voltage after being divided by the first resistor R1 and the second resistor R2 breaks down the threshold-voltage conduction unit ZD1; the switching element SCR1 is switched on as the voltage reaches the trigger threshold; and as an input power is increased, a fuse RF1 of the LED driver circuit is open-circuited, and a mains input is disconnected, so that the output terminal capacitor EC1 can be protected. Meanwhile, the one-way conduction unit D2 prevents energy stored on the output terminal capacitor EC1 from being recharged into the switching element SCR1, so as to prevent the switching element SCR1 from being damaged by an excessively large instantaneous current due to the conduction short circuit.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "unit," or "sub-unit" may include memory (shared, dedicated, or group) that stores code or instructions that can be executed by one or more processors.

An objective of the present disclosure may be to provide a protective circuit for an output terminal capacitor of an LED driver.

In order to achieve the above objective, the present disclosure may adopt the following technical proposal: a protective circuit for an output terminal capacitor of an LED driver, with the protective circuit being connected to two sides of the output terminal capacitor, comprising a switching element, a voltage dividing unit and a one-way conduction unit, wherein the switching element is in parallel connection with the output terminal capacitor, the one-way conduction unit is connected between the switching element and the output terminal capacitor, the switching element is switched on when a voltage exceeds a threshold so as to establish a short circuit between two ends of the output terminal capacitor and prevent an excessively large voltage from being applied to the output terminal capacitor, and the one-way conduction unit allows a current to flow across the output terminal capacitor from the protective circuit by a one-way conduction.

Preferably, the protective circuit further may include a threshold-voltage conduction unit. The threshold-voltage conduction unit is connected between the voltage dividing unit and the switching element and is switched on when a voltage at two ends of the protective circuit exceeds a certain value.

Preferably, the threshold-voltage conduction unit may be a triode.

Preferably, the protective circuit further may include a filter capacitor. One end of the filter capacitor is connected between the threshold-voltage conduction unit and the switching element, and another end of the filter capacitor is connected with a connection point of the switching element and the output terminal capacitor.

Preferably, the one-way conduction unit is a diode.

Preferably, the switching element may be a thyristor.

Preferably, the protective circuit may be applied to an output terminal of a buck topology circuit.

Preferably, the LED driver may include an LED driver circuit provided with the buck topology circuit.

Compared with existing technologies, the protective circuit for the output terminal capacitor of the LED driver provided by the present disclosure has the following advantages: not only the output terminal capacitor can be effectively protected, but also the current will not flow back to damage the switching element in the protective circuit when the output terminal capacitor has a high voltage.

A method may be provided for providing a protective circuit for an output terminal capacitor of a light-emitting diode (LED) driver, with the protective circuit being connected to two sides of the output terminal capacitor. The method may include connecting a switching element in parallel with the output terminal capacitor; connecting a one-way conduction unit between the switching element and the output terminal capacitor; switching a switching element on when a voltage exceeds a threshold so as to establish a short circuit between two ends of the output terminal capacitor and prevent an excessively large voltage from being applied to the output terminal capacitor; and allowing a current, by the one-way conduction unit, to flow across the output terminal capacitor from the protective circuit by a one-way conduction.

The method may further include connecting a threshold-voltage conduction unit between the voltage dividing unit and the switching element; and switching threshold-voltage conduction unit on when a voltage at two ends of the protective circuit exceeds a certain value.

When performing the method, the threshold-voltage conduction unit may be a triode.

The method may further include connecting one end of a filter capacitor between the threshold-voltage conduction unit and the switching element; and connecting another end of the filter capacitor to a connection point of the switching element and the output terminal capacitor.

When performing the method, the one-way conduction unit may be a diode.

When performing the method, the switching element may be a thyristor.

The method may further include applying the protective circuit to an output terminal of a buck topology circuit.

When performing the method, the LED driver may include an LED driver circuit provided with the buck topology circuit.

It should be noted that the embodiments of the present disclosure include preferred implementations and are not intended to limit the present disclosure in any form. Equivalent effective embodiments may be obtained by changing or modifying the technical content disclosed above by those skilled in the art. But any modification or equivalent change and modification made to the above embodiments, on the basis of the technical essence of the present disclosure without departing from the content of the technical proposal of the present disclosure, shall still fall within the scope of the technical proposal of the present disclosure.

What is claimed is:

1. A protective circuit for an output terminal capacitor of a light-emitting diode (LED) driver, comprising:

a switching element;

a voltage dividing unit;

a first one-way conduction unit; and a second one-way conduction unit;

wherein the switching element is in parallel connection with the output terminal capacitor, the second one-way conduction unit is connected, in serial, between the switching element and the output terminal capacitor, the switching element is switched on when a voltage exceeds a threshold so as to establish a short circuit between two ends of the output terminal capacitor and prevent an excessively large voltage from being applied to the output terminal capacitor, the first one-way conduction unit is coupled to the switching element for rectifying voltage applied to the switching element, and the second one-way conduction unit allows a current to flow across the output terminal capacitor from the protective circuit by a one-way conduction;

wherein the protective circuit further comprises a threshold-voltage conduction unit, the threshold-voltage conduction unit is connected between the voltage dividing unit and the switching element and is switched on when a voltage at two ends of the protective circuit exceeds a certain value;

wherein the protective circuit is connected to two sides of the output terminal capacitor; and wherein the protective circuit further comprises a filter capacitor, one end of the filter capacitor is connected between the threshold-voltage conduction unit and the switching element, and another end of the filter capacitor is connected to a connection point of the switching element and the output terminal capacitor.

2. The protective circuit for the output terminal capacitor of the LED driver according to claim 1, wherein the threshold-voltage conduction unit is a transistor.

3. The protective circuit for the output terminal capacitor of the LED driver according to claim 1, wherein the first one-way conduction unit is a diode.

4. The protective circuit for the output terminal capacitor of the LED driver according to claim 1, wherein the switching element is a thyristor.

5. The protective circuit for the output terminal capacitor of the LED driver according to claim 4, wherein the protective circuit is applied to an output terminal of a buck topology circuit.

6. The protective circuit for the output terminal capacitor of the LED driver according to claim 5, wherein the LED driver comprises an LED driver circuit provided with the buck topology circuit.

7. A method for providing a protective circuit for an output terminal capacitor of a light-emitting diode (LED) driver, with the protective circuit being connected to two sides of the output terminal capacitor, comprising:

connecting a switching element in parallel with the output terminal capacitor;

connecting a first one-way conduction unit to the switching element for rectifying voltage applied to the switching element;

connecting a second one-way conduction unit, in serial, between the switching element and the output terminal capacitor;

switching a switching element on when a voltage exceeds a threshold so as to establish a short circuit between two ends of the output terminal capacitor and prevent an excessively large voltage from being applied to the output terminal capacitor;

allowing a current, by the second one-way conduction unit, to flow across the output terminal capacitor from the protective circuit by a one-way conduction;

connecting a threshold-voltage conduction unit between the voltage dividing unit and the switching element;

switching the threshold-voltage conduction unit on when a voltage at two ends of the protective circuit exceeds a certain value;

connecting one end of a filter capacitor between the threshold-voltage conduction unit and the switching element; and connecting another end of the filter capacitor to a connection point of the switching element and the output terminal capacitor.

8. The method of claim 7, wherein the threshold-voltage conduction unit is a transistor.

9. The method of claim 7, wherein the first one-way conduction unit is a diode.

10. The method of claim 7, wherein the switching element is a thyristor.

11. The method of claim 10, further comprising:

applying the protective circuit to an output terminal of a buck topology circuit.

12. The method of claim 11, wherein the LED driver comprises an LED driver circuit provided with the buck topology circuit.

13. The protective circuit for the output terminal capacitor of the LED driver according to claim 1, wherein the voltage dividing unit is connected to the first one-way conduction unit and the second one-way conduction unit.

14. The method of claim 7, wherein the voltage dividing unit is connected to the first one-way conduction unit and the second one-way conduction unit.

* * * * *